US009560463B2

(12) United States Patent
Chen et al.

(10) Patent No.: US 9,560,463 B2
(45) Date of Patent: Jan. 31, 2017

(54) MULTISTAGE MINIMUM VARIANCE DISTORTIONLESS RESPONSE BEAMFORMER

(71) Applicant: Northwestern Polytechnical University, Shaanxi (CN)

(72) Inventors: Jingdong Chen, Shaanxi (CN); Chao Pan, Shaanxi (CN); Jacob Benesty, Montreal (CA)

(73) Assignee: Northwestern Polytechnical University, Xi'An, Shaanxi (CN)

( * ) Notice: Subject to any disclaimer, the term of this patent is extended or adjusted under 35 U.S.C. 154(b) by 49 days.

(21) Appl. No.: 14/792,783

(22) Filed: Jul. 7, 2015

(65) Prior Publication Data

US 2016/0277862 A1 Sep. 22, 2016

Related U.S. Application Data

(60) Provisional application No. 62/136,037, filed on Mar. 20, 2015.

(51) Int. Cl.

| | |
|---|---|
| ***H04R 3/00*** | (2006.01) |
| ***H04R 29/00*** | (2006.01) |
| *H04R 1/40* | (2006.01) |

(52) U.S. Cl.

CPC ..... *H04R 29/005* (2013.01); *H04R 3/005* (2013.01); *H04R 1/40* (2013.01); *H04R 1/406* (2013.01); *H04R 2201/40* (2013.01); *H04R 2201/403* (2013.01); *H04R 2410/01* (2013.01); *H04R 2430/23* (2013.01)

(58) Field of Classification Search

CPC ... H04R 29/005; H04R 3/005; H04R 2410/01; H04R 201/403; H04R 2430/23; H04R 1/406; H04H 1/40

See application file for complete search history.

(56) References Cited

U.S. PATENT DOCUMENTS

| | | | | |
|---|---|---|---|---|
| 8,583,428 | B2 * | 11/2013 | Tashev | G10L 21/028 704/210 |
| 2014/0153740 | A1 * | 6/2014 | Wolff | H04R 3/005 381/92 |

* cited by examiner

*Primary Examiner* — Andrew L Sniezek
(74) *Attorney, Agent, or Firm* — Lowenstein Sandler LLP; Jialin Zhong, Esq.

(57) ABSTRACT

A system and method relate to receiving, by a processing device, a plurality of sound signals captured at a plurality of microphone sensors, wherein the plurality of sound signals are from a sound source, and wherein a number (M) of the plurality of microphone sensors is greater than three, determining a number (K) of layers for a multistage minimum variance distortionless response (MVDR) beamformer based on the number (M) of the plurality of microphone sensors, wherein the number (K) of layers is greater than one, and wherein each layer of the multistage MVDR beamformer comprises one or more mini-length MVDR beamformers, and executing the multistage MVDR beamformer to the plurality of sound signals to calculate an estimate of the sound source.

20 Claims, 8 Drawing Sheets

MULTISTAGE MINIMUM VARIANCE DISTORTIONLESS RESPONSE BEAMFORMER

CROSS-REFERENCE TO RELATED APPLICATION

This application claims the benefit of U.S. provisional application Ser. No. 62/136,037 filed on Mar. 20, 2015, the content of which is hereby incorporated by reference in its entirety.

TECHNICAL FIELD

This disclosure relates to a beamformer and, in particular, to a beamformer that includes multiple layers of mini-length minimum variance distortionless response (MVDR) beamformers used to estimate a sound source and reduce noise contained in signals received by a sensor array.

BACKGROUND

Each sensor in a sensor array may receive a copy of a signal emitted from a source. The sensor can be a suitable type of sensor such as, for example, a microphone sensor to capture sound. For example, each microphone sensor in a microphone array may receive a respective version of a sound signal emitted from a sound source at a distance from the microphone array. The microphone array may include a number of geographically arranged microphone sensors for receiving the sound signals (e.g., speech signals) and converting the sound signals into electronic signals. The electronic signals may be converted using analog-to-digital converters (ADCs) into digital signals which may be further processed by a processing device (e.g., a digital signal processor). Compared with a single microphone, the sound signals received at microphone arrays include redundancy that may be explored to calculate an estimate of the sound source to achieve noise reduction/speech enhancement, sound source separation, de-reverberation, spatial sound recording, and source localization and tracking. The processed digital signals may be packaged for transmission over communication channels or converted back to analog signals using a digital-to-analog converter (DAC).

The microphone array can be coupled to a beamformer, or directional sound signal receptor, which is configured to calculate the estimate of the sound source. The sound signal received at any microphone of the microphone array may include a noise component and a delayed component with respect to the sound signal received at a reference microphone sensor (e.g., a first microphone sensor in a microphone array). A beamformer is a spatial filter that uses the multiple copies of the sound signal received at the microphone array to identify the sound source according to certain optimization rules.

A minimum variance distortionless response (MVDR) beamformer is a type of beamformers that is obtained by minimizing the variance (or power) of noise at the beamformer while ensuring the distortionless response of the beamformer towards the direction of the desired source. The MVDR beamformer is commonly used in the context of noise reduction and speech enhancement using microphone arrays.

BRIEF DESCRIPTION OF THE DRAWINGS

The present disclosure is illustrated by way of example, and not by way of limitation, in the figures of the accompanying drawings.

DETAILED DESCRIPTION

Figure 1:
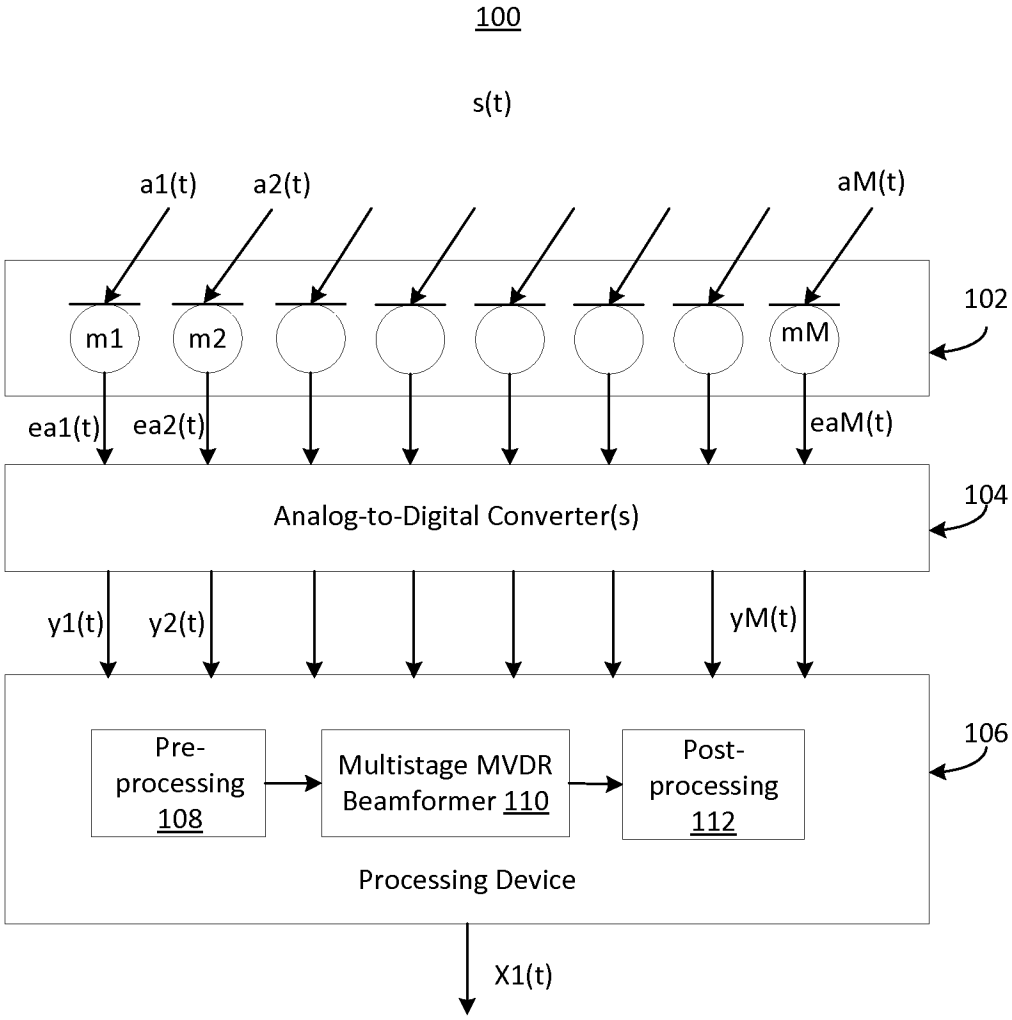
FIG. 1 illustrates a multistage beamformer system according to an implementation of the present disclosure.

An MVDR beamformer may receive a number of input signals and calculate an estimate of either the source signal or the sound source received at a reference microphone based on the input signals. The number of inputs is referred to as the length of the MVDR beamformer. Thus, when the number of inputs for the MVDR beamformer is large, the length of the MVDR beamformer is also long.

Implementations of long MVDR beamformers commonly require inversion of a large, ill-conditioned noise correlation matrix. Because of this inversion, MVDR beamformers introduce white noise amplification, particularly at low frequencies, due to the ill-condition of the noise correlation matrix. Further, the computation to inverse a large matrix is computationally expensive. This is especially true when the matrix inversion is calculated for each frequency sub-band over a wide frequency spectrum because the matrix inversion needs to be performed for each of the multiple frequency sub-bands. Therefore, there is a need for an MVDR beamformer that can achieve results similar to an MVDR beamformer, but is less sensitive to white noise amplification and requires less computation than the conventional MVDR.

Implementations of the present disclosure relate to a multistage MVDR beamformer including multiple layers of mini-length MVDR beamformers. The lengths of the mini-length MVDR beamformers are smaller or substantially smaller than the total number of input for the multistage MVDR beamformer (or correspondingly, the total number of microphone sensors in a microphone array). Each layer of the multistage MVDR beamformer includes one or more mini-length (e.g., length-2 or length-3) MVDR beamformers, and each mini-length MVDR beamformer is configured to calculate an MVDR estimate output for a subset of the input signals of the layer. The calculation of the multistage MVDR beamformer is carried out in cascaded layers progressively from a first layer to a last layer, whereas a first layer may receive the input signals from microphone sensors of the microphone array and produce a set of MVDR estimates as input signals to a second layer. Because each mini-MVDR beamformer produces one MVDR estimate for a subset of input signals, the number of input signals to the second layer is smaller than those of the first layers. Thus, the second layer includes fewer MVDR beamformers than the first layer. The second layer may similarly produce a further set of MVDR estimates of its input signals to be used as input signals to a subsequent third layer. Likewise, the third layer includes fewer MVDR beamformers than the second layer. This multistage MVDR beamforming propagates through these layers of mini-length MVDR beamformers till the last layer including one MVDR beamformer to produce an MVDR estimate for the multistage MVDR beamformer.

In one implementation, a microphone array may include M microphones (M>3) that provides M input signals to a multistage MVDR beamformer including multiple layers of length-2 MVDR beamformers. The first layer of the multistage MVDR beamformer may include M/2 length-2 MVDR beamformers. Each of the length-2 MVDR beamformers may be configured to receive two input signals captured at two microphones and calculate an MVDR estimate for the two input signals. The MVDR estimates from the length-2 MVDR beamformers are provided as M/4 input signals to a seconder layer.

The second layer may similarly include M/4 length-2 MVDR beamformers. Each of the length-2 MVDR beamformers of the second layer may receive two input signals received from the first layer and calculate an MVDR estimate for the two input signals. The second layer may generate M/8 MVDR estimates which may be provided to a next layer of length-2 MVDR beamformers.

This process of length-2 MVDR beamforming may be performed repeatedly in stages through layers of length-2 MVDR beamformers till the calculation of the multistage MVDR beamformer reaches an $N^{th}$ layer that includes only one length-2 MVDR beamformer receiving two input signals from the $(N-1)^{th}$ layer and calculating an MVDR estimate for the two input signals received from the $(N-1)^{th}$ layer. In one implementation, the length-2 MVDR estimate of the $N^{th}$ layer is the result of the multistage MVDR beamformer. Because multistage MVDR beamformer only needs to perform the calculation of length-2 MVDR beamformers including the inversion of a two-by-two noise correlation matrix, the need to inverse the ill-conditioned, large noise correlation matrices is eliminated, thereby mitigating the white noise amplification problem associated with a single-stage long MVDR beamformer for a large microphone array. Further, the multistage MVDR beamformer is computationally more efficient than the computation of a single-stage MVDR beamformer with a large number (M) of microphone sensors (e.g., when M is greater than or equal to eight). Further, because of the less computation requirement, the multistage MVDR beamformers may be implemented on less sophisticated (or cheaper) hardware processing devices than single-stage long MVDR beamformers while achieving similar noise reduction performance.

Implementations of the present disclosure may relate to a method including receiving, by a processing device, a plurality of sound signals captured at a plurality of microphone sensors, wherein the plurality of sound signals are from a sound source, and wherein a number (M) of the plurality of microphone sensors is greater than three, determining a number (K) of layers for a multistage minimum variance distortionless response (MVDR) beamformer based on the number (M) of the plurality of microphone sensors, wherein the number (K) of layers is greater than one, and wherein each layer of the multistage MVDR beamformer comprises one or more mini-length MVDR beamformers, and executing the multistage MVDR beamformer to the plurality of sound signals to calculate an estimate of the sound source.

Implementations of the present disclosure may include a system including a memory and a processing device, operatively coupled to the memory, the processing device to receive a plurality of sound signals captured at a plurality of microphone sensors, wherein the plurality of sound signals are from a sound source, and wherein a number (M) of the plurality of microphone sensors is greater than three, determine a number (K) of layers for a multistage minimum variance distortionless response (MVDR) beamformer based on the number (M) of the plurality of microphone sensors, wherein the number (K) of layers is greater than one, and wherein each layer of the multistage MVDR beamformer comprises one or more mini-length MVDR beamformers, and execute the multistage MVDR beamformer to the plurality of sound signals to calculate an estimate of the sound source.

FIG. 1 illustrates a multistage beamformer system 100 according to an implementation of the present disclosure. As shown in FIG. 1, the multistage beamformer 100 may include a microphone array 102, an analog-to-digital converter (ADC) 104, and a processing device 106. Microphone array 102 may further include a number of microphone sensors ($m_1, m_2, \ldots, m_M$), wherein the M is an integer number larger than three. For example, the microphone array 102 may include eight or more microphone sensors. The microphone sensors of microphone array 102 may be configured to receive sound signals. In one implementation, the sound signal may include a first component from a sound source (s(t)) and a second noise component (e.g., ambient noise), wherein t is the time. Due to the spatial distance between microphone sensors, each microphone sensor may receive a different versions of the sound signal (e.g., with different amount of delays with respect to a reference microphone sensor) in addition to the noise component. As shown in FIG. 1, microphone sensors $m_1, m_2, \ldots, m_M$ may be configured to receive a respective version of the sound, $a_1(t), a_2(t), \ldots, a_M(t)$. Each of $a_1(t), a_2(t), \ldots, a_M(t)$ may include a delayed copy of the sound source (s(t+n*d)) and a noise component ($v_n(t)$, wherein n=1, 2, . . . , M, and d is the time delay between two adjacent microphone sensors in the microphone array that includes equally-spaced microphone sensors. Thus, $a_n(t)=s(t+n*d)+v_n(t)$, wherein n=1, 2, . . . , M.

The microphone sensors on the microphone array 102 may convert $a_1(t), a_2(t), \ldots, a_M(t)$ into electronic signals $ea_1(t), ea_2(t), \ldots, ea_M(t)$ that may be fed into the ADC 104. In one implementation, the ADC 104 may be configured to convert the electronic signals into digital signals $y_1(t), y_2(t), \ldots, y_M(t)$ by quantization.

In one implementation, the processing device 106 may include an input interface (not shown) to receive the digital signals, and as shown in FIG. 1, the processing device may be configured to implement modules that may identify the sound source by performing a multistage MVDR beamformer 110. To perform the multistage MVDR beamformer 110, in one implementation, the processing device 106 may be configured with a pre-processing module 108 that may further process the digital signal $y_1(t), y_2(t), \ldots, y_M(t)$ in preparation for the multistage MVDR beamformer 110. In one implementation, the pre-processing module 108 may convert the digital signals $y_1(t), y_2(t), \ldots, y_M(t)$ into frequency domain representations using short-time Fourier transforms (STFT) or any suitable type of frequency transforms. The STFT may calculate the Fourier transform of its input signal over a series of time frames. Thus, the digital signals $y_1(t), y_2(t), \ldots, y_M(t)$ may be processed over the series of time frames.

In one implementation, the pre-processing module 108 may be configured to perform STFT on the input $y_1(t), y_2(t), \ldots, y_M(t)$ and generate the frequency domain representations $Y_1(\omega), Y_2(\omega), \ldots, Y_M(\omega)$, wherein $\omega(\omega=2\pi f)$ represents the angular frequency domain. In one implementation, the multistage MVDR beamformer 110 may be configured to receive frequency representations $Y_1(\omega), Y_2(\omega), \ldots, Y_M(\omega)$ of the input signals and calculate an estimate $Z(\omega)$ in the frequency domain of the sound source (s(t)) based on the received $Y_1(\omega), Y_2(\omega), \ldots, Y_M(\omega)$. In one implementation, the frequency domain may be divided into a number (L) of frequency sub-bands, and the multistage MVDR beamformer 110 may calculate the estimate $Z(\omega)$ for each of the frequency sub-bands.

The processing device 106 may be configured with a post-processing module 112 that may convert the estimate $Z(\omega)$ for each of the frequency sub-bands back into the time domain to provide the estimate sound source ($X_1(t)$). The estimated sound source ($X_1(t)$) may be determined with respect to the source signal received at a reference microphone sensor (e.g., $m_1$).

Figure 2:
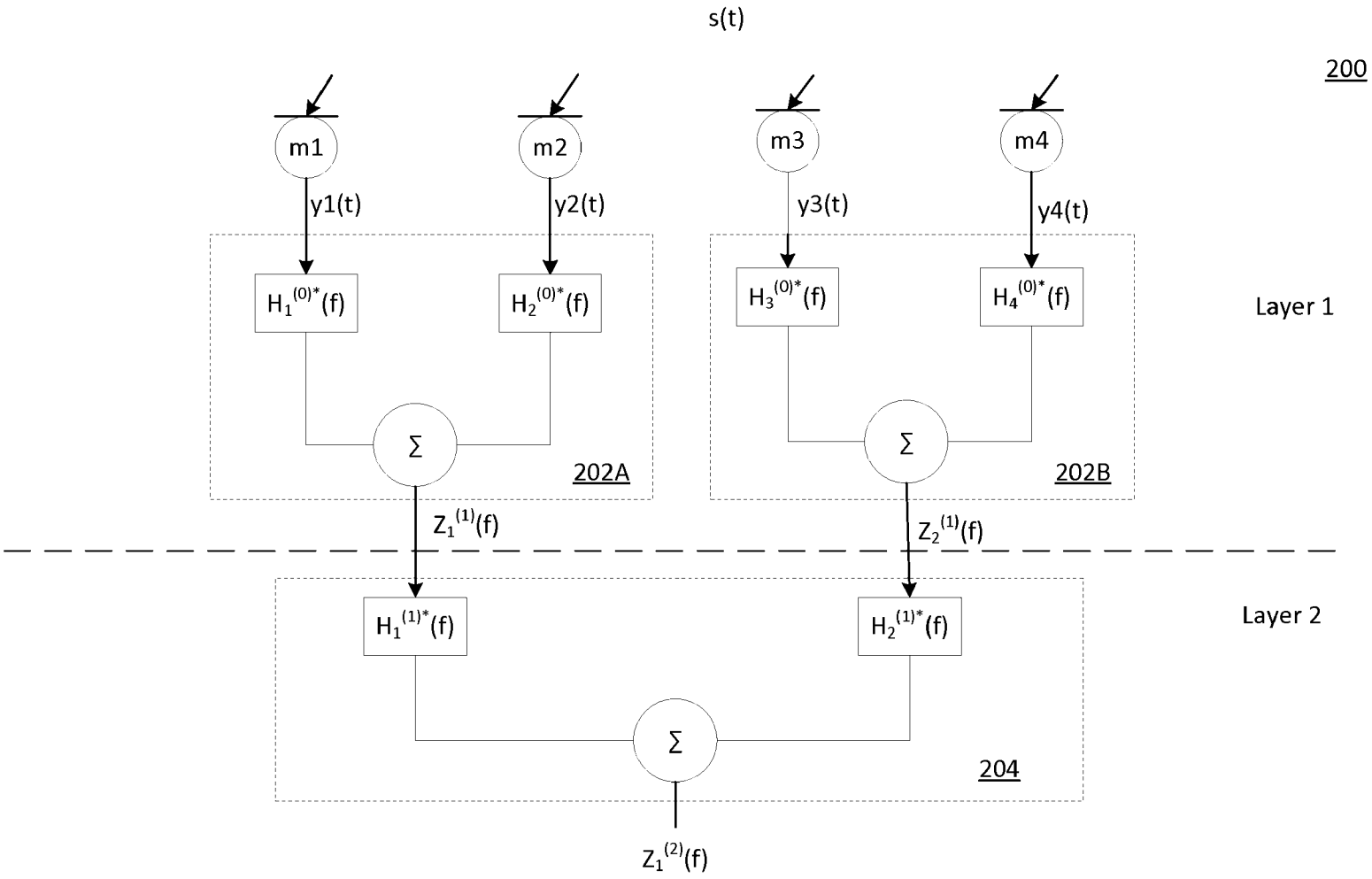
FIG. 2 shows a multistage MVDR beamformer according to an implementation of the present disclosure.

Instead of using a single-stage long MVDR beamformer to estimate the sound signal (s(t)), implementations of the present disclosure provides for a multistage MVDR beamformer that includes one or more layers of mini-length MVDR beamformers that together may provide an estimate that is substantially similar distortionless character as the single-stage MVDR beamformer but with less noise amplification and more efficient computation. FIG. 2 shows a multistage MVDR beamformer 200 according to an implementation of the present disclosure. For simplicity and clarity of description, the multistage MVDR beamformer 200, as shown in FIG. 2, includes two layers of length-2 MVDR beamformers configured to calculate an estimate of a sound source signal that is captured by microphone sensors $m_1$–$m_4$. It is understood, however, that the same principles may be equally applicable to multistage MVDR beamformers that include a pre-determined numbers of layers of mini-length MVDR beamformers.

Referring to FIG. 2, the multistage MVDR beamformer 200 may receive input sound signals captured at the microphone sensors $m_1$–$m_4$. The sound signals are noisy input and may be represented as $y_m(t)=g_m(t)*s(t)+v_m(t)=x_m(t)+v_m(t)$, m=1, . . . , 4, wherein s(t) is the sound signal that needs to be estimated, $g_m(t)$ is the impulse response of the $m^{th}$ microphone sensor, $v_m(t)$ is the noise captured at the $m^{th}$ microphone sensor, and * represents the convolution operator. For this model, it is assumed that $x_m(t)$ and $v_m(t)$ are uncorrelated, and $v_m(t)$ is a zero mean random process. The noise may include both environmental noise from ambient noise sources and/or white noise from the microphone sensors or from analog-to-digital converters.

Instead of performing a length-4 MVDR beamformer for all input $y_m(t)$, m=1, . . . , 4, the multistage MVDR beamformer 200 as shown in FIG. 2 includes a first layer of two length-2 MVDR beamformers 202A, 202B, wherein length-2 MVDR beamformer 202A may receive input signals $y_1(t)$, $y_2(t)$ captured at microphones sensors $m_1$, $m_2$, and length-2 MVDR beamformer 202B may receive input signals $y_3(t)$, $y_4(t)$ captured at microphone sensors $m_3$, $m_4$. Prior to performing the beamforming operations, a pre-processing module (such as pre-processing module 108 as shown in FIG. 1) may convert input signals $y_m(t)$ to $Y_m(f)$, m=1, . . . , 4, wherein f represents frequency, using a frequency transform (e.g., STFT) to enable frequency domain beamforming calculation. The length-2 MVDR beamformer 202A may generate an MVDR estimate $Z_1^{(1)}(f)$ and length-2 MVDR beamformer 202B may generate an MVDR estimate $Z_2^{(1)}(f)$. The multistage MVDR beamformer 200 may further include a second layer of length-2 MVDR beamformer 204 that may receive, as input signals, the estimates $Z_1^{(1)}(f)$, $Z_2^{(1)}(f)$ (or their corresponding time domain representations) from the first layer. Length-2 MVDR beamformer 204 may generate a further estimate $Z_1^{(2)}(f)$ which is the estimate for the two-layer length-2 MVDR beamformer 200. Because the multistage MVDR beamformer 200 includes length-2 MVDR beamformers, the multistage MVDR beamformer 200 needs to calculate the inversions of a 2×2 correlation matrix (rather than the inversion of a 4x4 correlation matrix), thus reducing noise amplification due to ill-condition of the noise correlation matrix and improved computation efficiency associated with the inversion of a higher dimension matrix.

The mini-length MVDR beamformer may be any suitable type of MVDR beamformers. In one implementation, the mini-length MVDR beamformer may include applying complex weights $H_i^*(f)$, i=1, . . . , M' to each of the input signal received by the mini-length MVDR beam and calculate a weighted sum, wherein $f=\omega/2\pi$ is the frequency, the superscript * is the complex conjugate operator and M' is the length of the mini-length MVDR beamformer, and Σ is the sum operator. For the length-2 MVDR beamformers 202A, 202B, 206 as shown in FIG. 2, M'=2. In other implementations, M' can be any other suitable length such as, for example, M'=3. The weights of a mini-length MVDR filter may be derived based on the statistical characterization of the noise component $v_m(t)$ and calculated in according to the following representation:

$$h_{MVDR}(f) = \frac{\Phi_y^{-1}(f)d(f)}{d^H(f)\Phi_y^{-1}(f)d(f)} = \frac{\Phi_v^{-1}(f)\Phi_y(f) - I_{M'}}{tr[\Phi_v^{-1}(f)\Phi_y(f)] - M'} i_{M'}, \quad (1)$$

wherein $h_{MVDR}$ is a vector including elements of the MVDR weights and is defined as $h_{MVDR}=[H_1(f), H_2(f), \ldots, H_{M'}(f)]^T$, $\Phi_v(f)=E[v(f)v^H(f)]$ and $\Phi_y(f)=E[y(f)y^H(f)]$are the correlation matrices of the noise vector $v(f)=[V_1(f), V_2(f), \ldots, V_M(f)]^T$ and the noisy signal vector $y(f)=[Y_1(f), Y_2(f), \ldots, Y_{M'}(f)]^T$, $d(f)=[1, e^{-j2\pi f\tau 0 \cos(\Theta d)}, \ldots, e^{-j2\pi(M'-1)f\tau 0 \cos(\Theta d)}]^T$ is the steering vector where $\sigma_0$ is the delay between two adjacent microphone sensors at an incident angle $\theta_d=0°$, superscript T represents the transpose operator, superscript H represents the conjugate-transpose operator, tr[.] represents the trace operator, $I_{M'}$ is the identity matrix of size M', and $i_{M'}$ is the first column of $I_{M'}$. As shown in Equation (1), the calculation of $_{MVDR}$ includes inversion of a noise correlation matrix $\Phi_v$ of size M'. Because the mini length (M') is smaller than the total number (M) of microphone sensors, the inversion is easier to calculate and the noise amplification may be mitigated in the multistage MVDR beamformers. The noise correlation matrix $\Phi_v(f)$ may be calculated using a noise estimator during a training process when the sound source is absent. Alternatively, the noise correlation matrix may be calculated online. For example, when the sound source is a human speaker, the noise correlation matrix may be calculated when the speaker pauses. The steering vector d(f) may be derived from a given incident angle (or look direction) of the sound source with respect to the microphone array. Alternatively, the steering vector may be calculated using a direction-or-arrival estimator to estimate the delays.

Figure 3A:
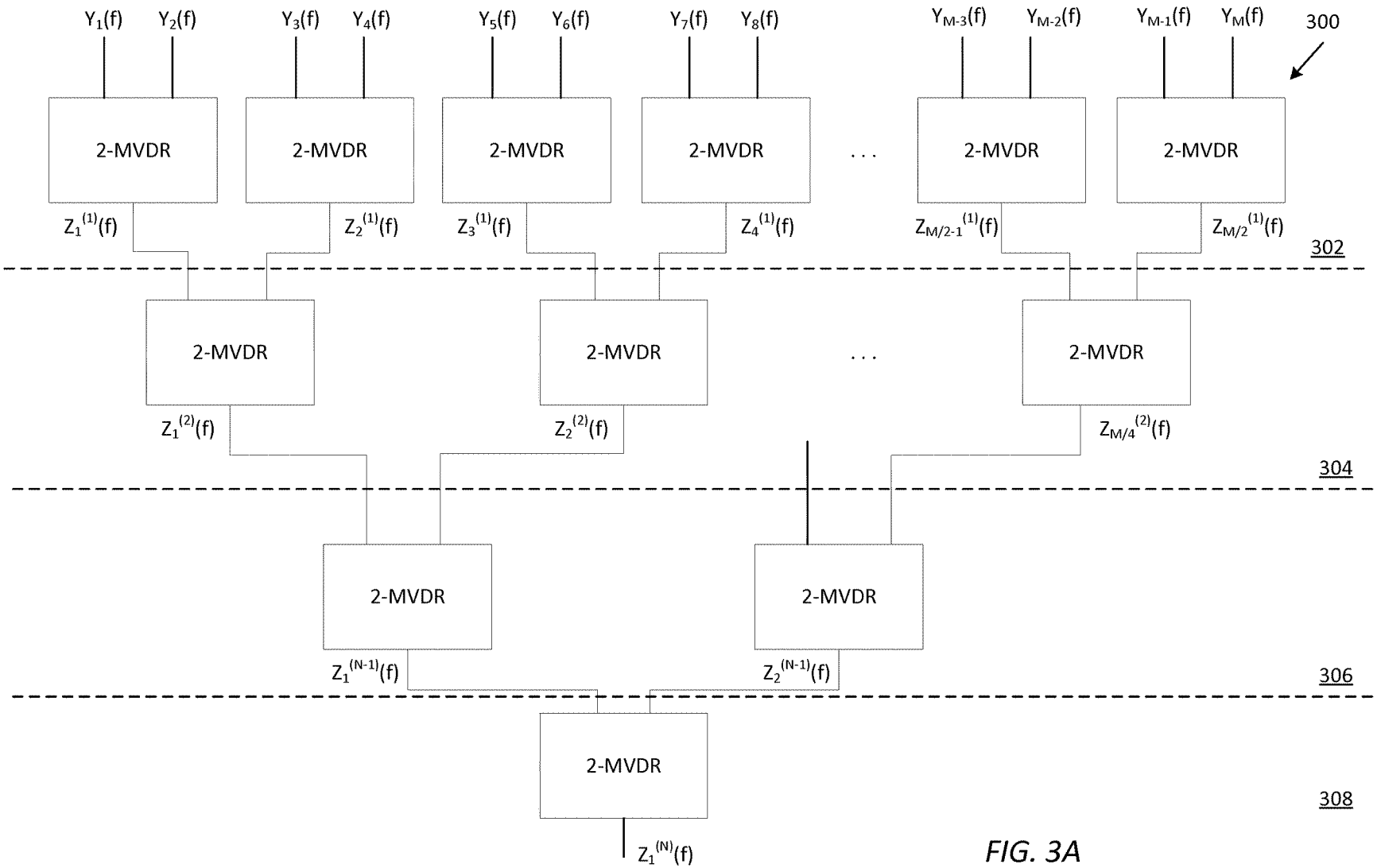
FIGS. 3A-3D show different types of multistage MVDR beamformers according to some implementations of the present disclosure.

The multistage MVDR beamformer may include multiple cascaded layers of different combinations of mini-length MVDR (M-MVDR). FIG. 3A shows a multistage MVDR beamformer 300 according to an implementation of the present disclosure. As shown in FIG. 3A, the multistage MVDR beamformer 300 includes layers of 2-MVDR beamformers. A first layer 302 may include M/2 2-MVDR beamformers to receive the noisy input $Y_1(f), Y_2(f), \ldots, Y_M(f)$. The M/2 2-MVDR beamformers of the first layer 302 may produce M/2 estimates $Z_1^{(1)}(f)$, $Z_2^{(1)}(f)$, . . . , $Z_{M/2}^{(1)}(f)$. Similarly, a second layer 304 may include M/4 2-MVDR beamformers to receive the estimates $Z_1^{(1)}(f)$, $Z_2^{(1)}(f)$, . . . , $Z_{M/2}^{(1)}(f)$ generated from the first layer 302. The 2-MVDR beamformers of the second layer 304 may generate M/4 estimates $Z_1^{(2)}(f)$, $Z_2^{(2)}(f)$, . . . , $Z_{M/4}^{(2)}(f)$. Thus, each additional layer may generate progressively fewer estimates until the $(N-1)^{th}$ layer which is the next to last layer 306 that generate two estimate $Z_1^{(N-1)}(f)$, $Z_2^{(N-1)}(f)$ which may be fed to the 2-MVDR beamformer in the last layer 308 to generate the estimate of the sound source $Z_1^{(N)}(f)$ for the multistage MVDR beamformer 300.

Figure 3B:
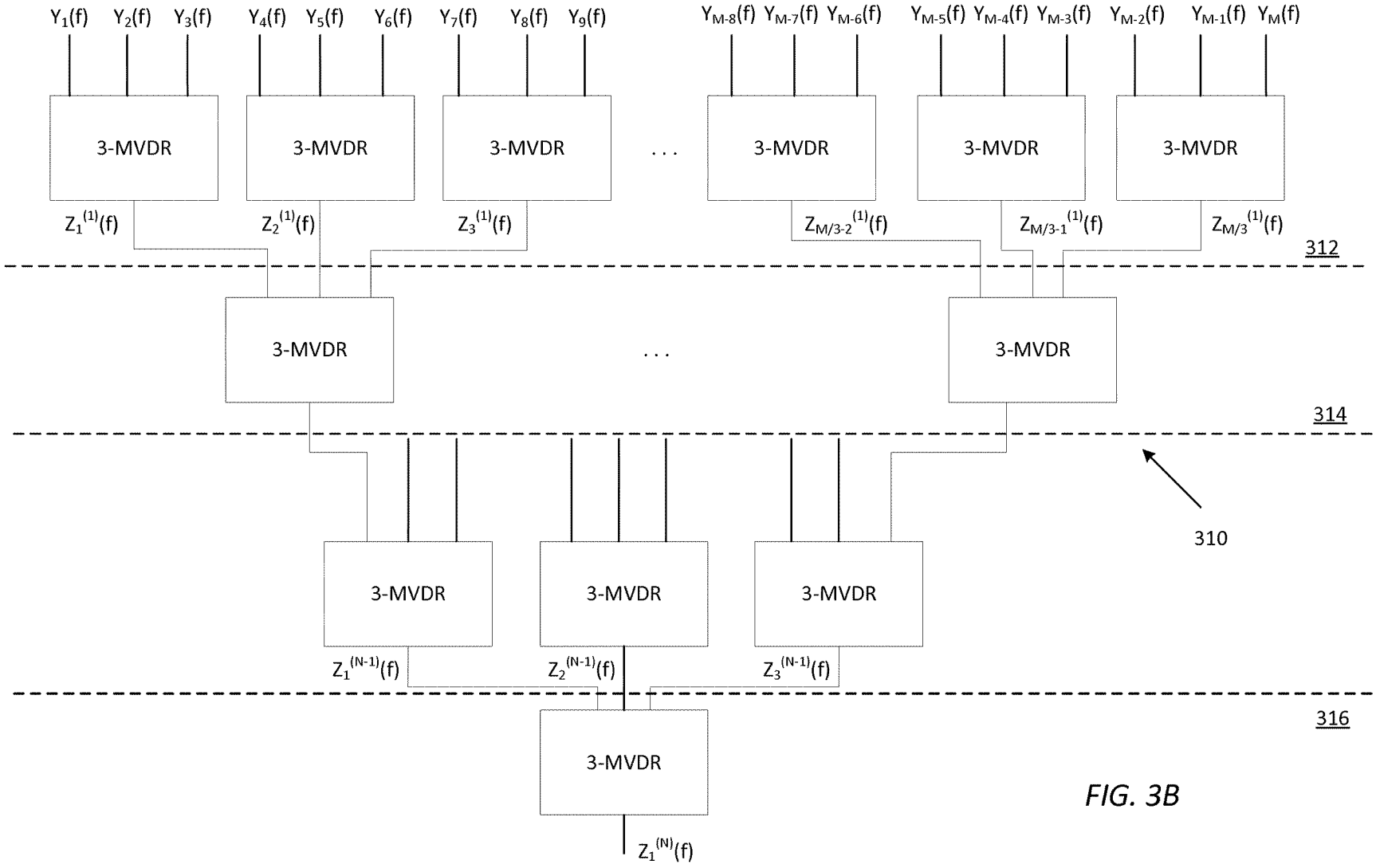

FIG. 3B shows a multistage MVDR beamformer 310 including layers of 3-MVDR beamformers according to an implementation of the present disclosure. As shown in FIG. 3B, each layer of the multistage MVDR beamformer 310 may include one or more 3-MVDR beamformers and generate a number of estimates for the input signals received at that layer. The number of estimates for each layer is one third of the number of input signals. Thus, a first layer may receive noisy input $Y_1(f)$, $Y_2(f)$, . . . , $Y_M(f)$. The M/3 3-MVDR beamformers of the first layer 312 may produce M/3 estimates $Z_1^{(1)}(f)$, $Z_2^{(1)}(f)$, . . . , $Z_{M/3}^{(1)}(f)$. Similarly, the second layer 314 may receive the M/3 estimates $Z_1^{(1)}(f)$, $Z_2^{(1)}(f)$, . . . , $Z_{M/3}^{(1)}(f)$ and generate M/9 estimate. This calculation of the multistage MVDR beamformer 310 may progress till the last layer 316 that may include one 3-MVDR beamformer to generate the estimate $Z_1^{(N)}(f)$ for the multistage MVDR beamformer 310.

Figure 3C:
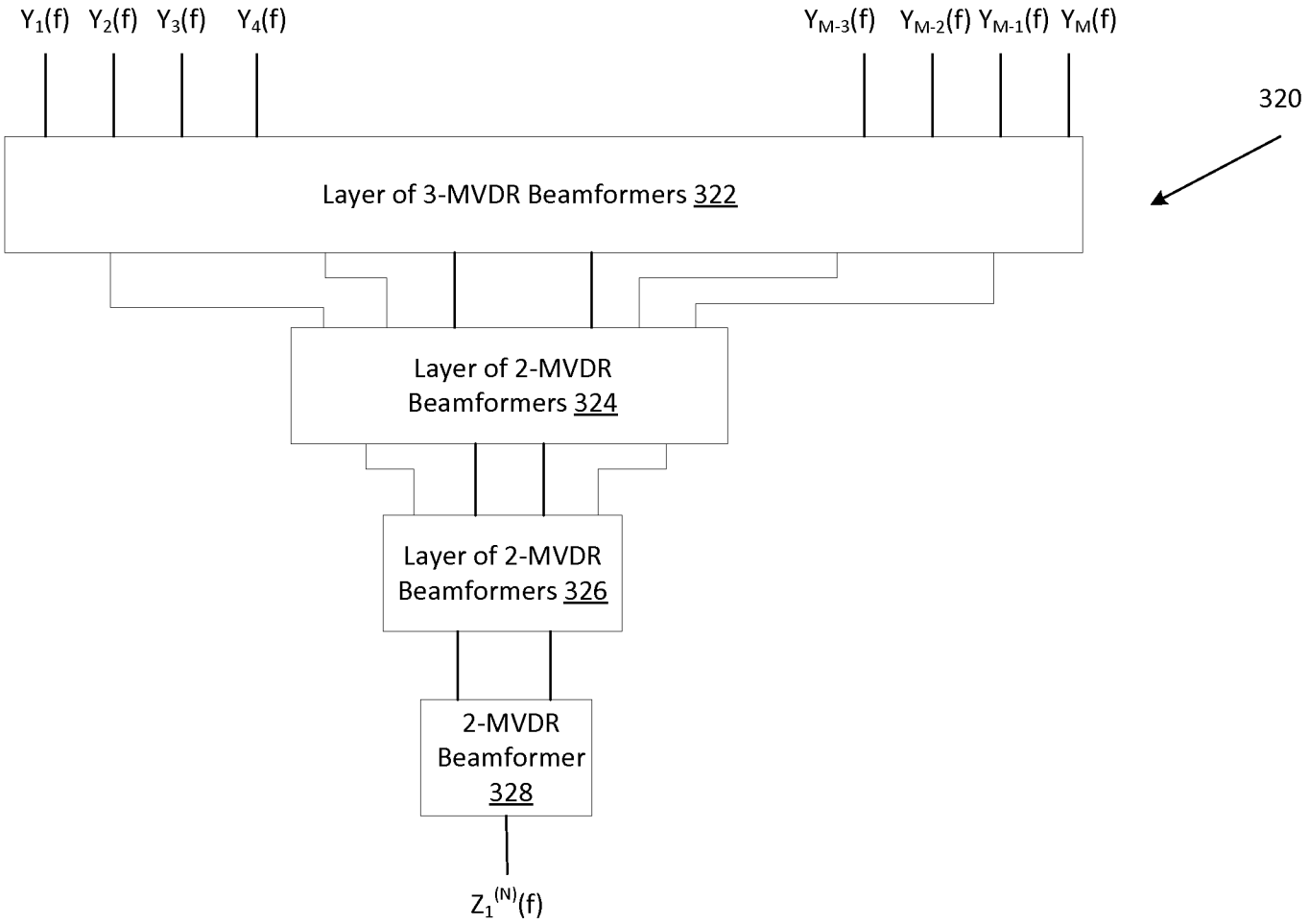

In some implementations, a multistage MVDR beamformer may include layers of mini-length MVDR beamformers of different lengths. For example, the multistage MVDR beamformer may include one or more layers of 2-MVDR beamformers and one or more layers of 3-MVDR beamformers. In one implementation, the layer of longer length mini-length MVDR beamformers may be used in earlier stages to rapidly reduce the number of input to a smaller number of estimates, and the layers of smaller length mini-length MVDR beamformers may be used in later stages to generate finer estimates. FIG. 3C shows a multistage MVDR beamformer 320 including mixed layers of mini-length MVDR beamformers according to an implementation of the present disclosure. As shown in FIG. 3C, the first layer 322 may include 3-MVDR beamformers, and later layers 324, 326, 328 may include 2-MVDR beamformers. Thus, the first layer 322 may receive noisy input signals and generate one third number of estimates. The rest layers 324, 326, 328 may further reduce the number of estimates by a factor of two until the last layer 328 to generate an estimate $Z_1^{(N)}(f)$ for the multistage MVDR beamformer 320.

Figure 3D:
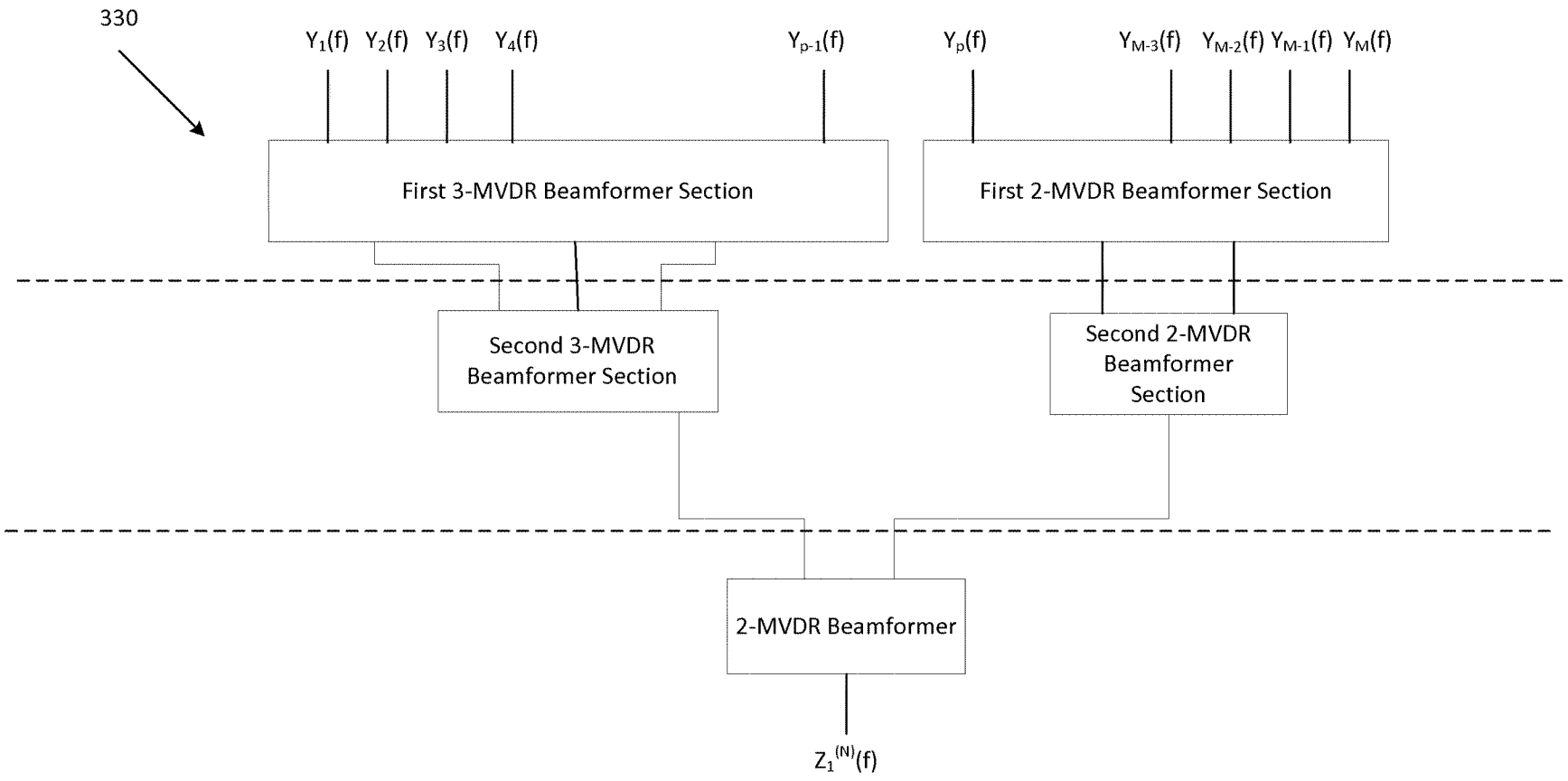

In some implementations, a multistage MVDR beamformer may include one or more layers that each includes mini-length MVDR beamformers of different lengths. For example, the multistage MVDR beamformers may process a first section (e.g., microphone sensors on the edge sections of the microphone array) of noisy input using 2-MVDR beamformers and a second section (e.g., microphone sensors in the middle section of the microphone array) of noisy input using 3-MVDR beamformers. This type of multistage beamformers may provide different treatments for different sections of microphone sensors based on the locations of microphone sensors in a microphone array rather than using a uniform treatment for all microphone sensors. FIG. 3D shows a multistage MVDR beamformer 330 including layers of mixed mini-length MVDR beamformers according to an implementation of the present disclosure. As shown in FIG. 3D, the noisy input signals may be divided into sections. A first section may include $Y_1(f)$, $Y_2(f)$, . . . , $Y_{P-1}(f)$, and a second section may include $Y_p(f)$, . . . , $Y_M(f)$. The first layer of the multistage MVDR beamformer 330 may include a first layer that includes a first 3-MVDR beamformer section to process $Y_1(f)$, $Y_2(f)$, . . . , $Y_{P-1}(f)$, and a first 2-MVDR beamformer section to process $Y_P(f)$, . . . , $Y_M(f)$. The estimates from the first 3-MVDR beamformer section may be further processed by one or more 3-MVDR beamformer sections, and the estimate from the first 2-MVDR beamformer section may be further processed by one or more 2-MVDR beamformer sections. The last layer may include a 2-MVDR beamformer that may generate an estimate $Z_1^{(N)}(f)$ for the multistage MVDR beamformer 330.

Figure 4:
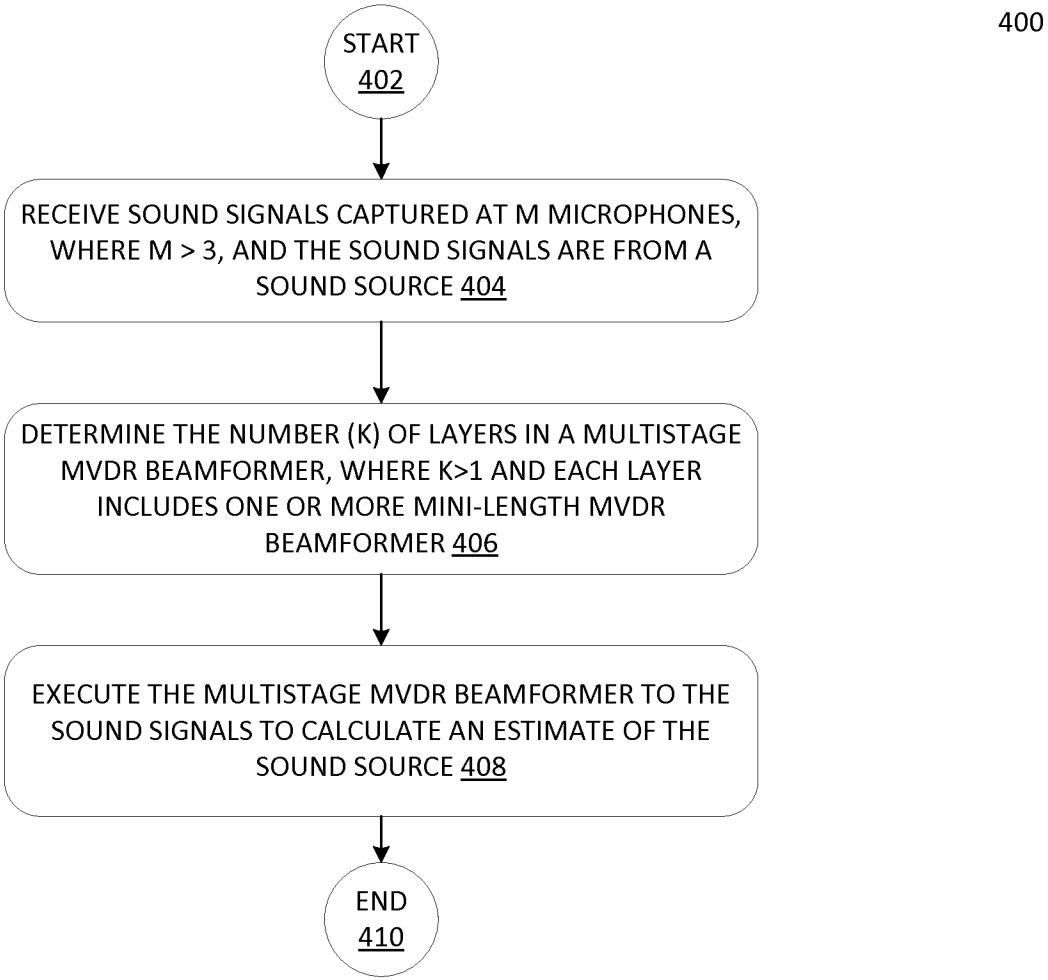
FIG. 4 is a flow diagram illustrating a method to estimate a source using a multistage MVDR beamformer according to some implementations of the present disclosure

FIG. 4 is a flow diagram illustrating a method 400 to estimate a sound source using a multistage MVDR beamformer according to some implementations of the disclosure. The method 300 may be performed by processing logic that comprises hardware (e.g., circuitry, dedicated logic, programmable logic, microcode, etc.), software (e.g., instructions run on a processing device to perform hardware simulation), or a combination thereof.

For simplicity of explanation, methods are depicted and described as a series of acts. However, acts in accordance with this disclosure can occur in various orders and/or concurrently, and with other acts not presented and described herein. Furthermore, not all illustrated acts may be required to implement the methods in accordance with the disclosed subject matter. In addition, the methods could alternatively be represented as a series of interrelated states via a state diagram or events. Additionally, it should be appreciated that the methods disclosed in this specification are capable of being stored on an article of manufacture to facilitate transporting and transferring such methods to computing devices. The term article of manufacture, as used herein, is intended to encompass a computer program accessible from any computer-readable device or storage media. In one implementation, the methods may be performed by the multistage MVDR beamformer 110 executed on the processing device 106 as shown in FIG. 1.

Referring to FIG. 4, at 402, the processing device may start executing operations to calculate an estimate for a sound source such as a speech source. The sound source may emit sound that may be received by a microphone array including microphone sensors that may convert the sound into sound signals. The sound signals may be electronic signals including a first component of the sound and a second component of noise. Because the microphone sensors are commonly located on a platform and are separated by spatial distances (e.g., microphone sensors are located on a linear array with an equal distance), the first components of the sound signals may vary due to the temporal delays of the sound arriving at the microphone sensors.

At 404, the processing device may receive the sound signals from the microphone sensors. In one implementation, a microphone array may include M (M>3) microphone sensors, and the processing device is configured to receive the M sound signals from the microphone sensors.

At 406, the processing device may determine a number of layers of a multistage MVDR beamformer that is to be used to estimate the sound source. The multistage MVDR beamformer may be used for noise reduction and produce a cleaned version of the sound source (e.g., speech). In one implementation, the multistage MVDR beamformer may be constructed to include K (K>1) layers, and each layer may include one or mini-length MVDR beamformers, wherein the lengths (M') of the mini-length MVDR beamformers are smaller than the number (M) of microphone sensors.

At 408, the processing device may execute the multistage MVDR beamformer to calculate an estimate for the sound source. In one implementation, the K layers of the multistage MVDR beamformer may be cascaded from a first layer to the $K^{th}$ layer with progressively decreasing numbers of mini-length MVDR beamformers from the first layer to the $K^{th}$ layer. In one implementation, the first layer may include M/2 length-2 MVDR beamformers, and each of the length-2 MVDR beamformers of the first layer may be configured to receive two sound signals and calculate a length-2 MVDR estimate for the two sound signals. Thus, the first layer may produce M/2 estimates which may be fed into a second layer. Similarly, the second layer may include M/4 length-2 MVDR beamformers that generate M/8 estimates. This estimation process may be repeated till it reaches the $K^{th}$ layer which may include one length-2 MVDR beamformer that calculate the an estimate of the sound source for the M sound signals received from the M microphone sensors.

Figure 5:
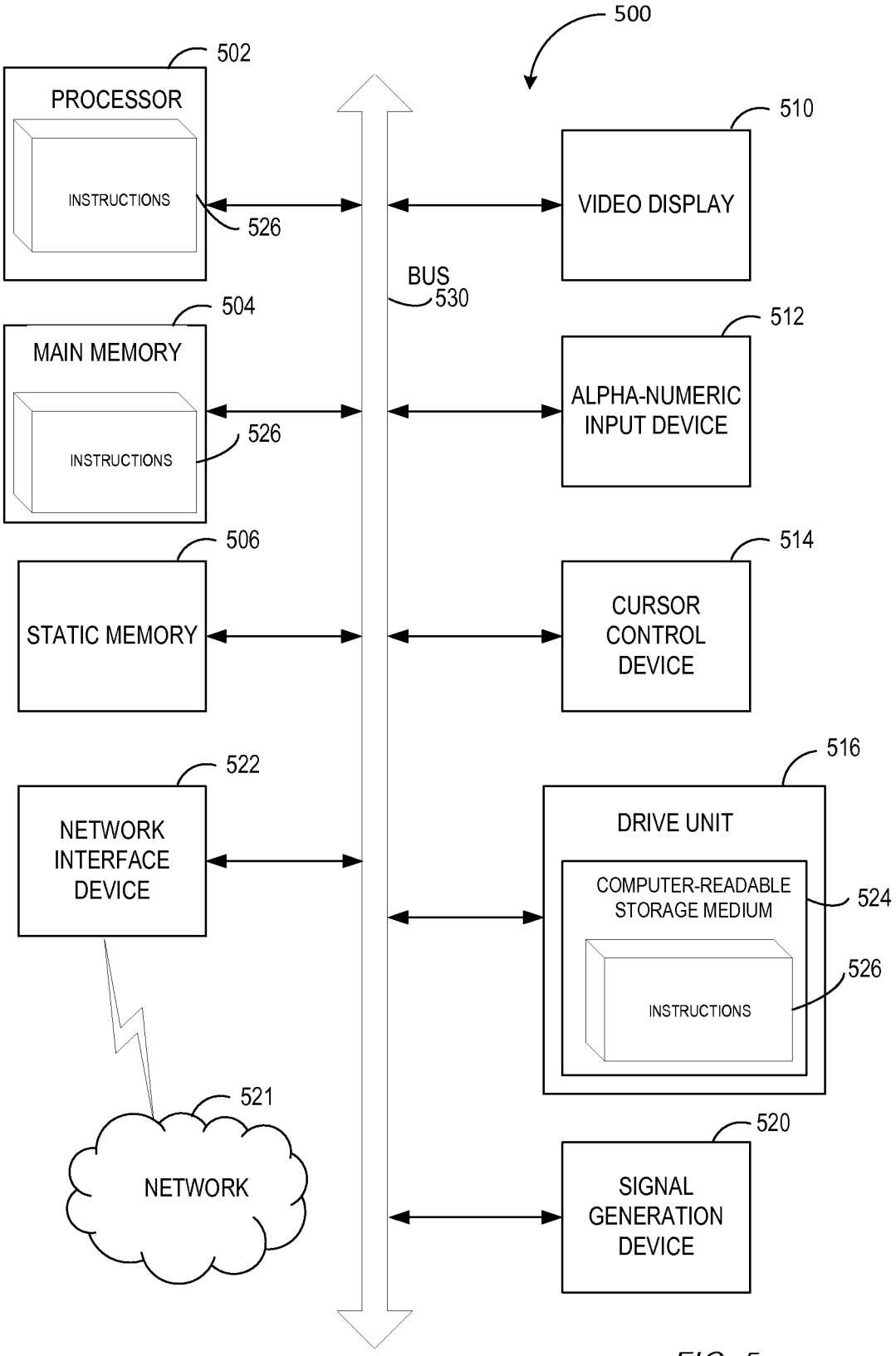
FIG. 5 is a block diagram illustrating an exemplary computer system, according to some implementations of the present disclosure.

FIG. 5 illustrates a diagrammatic representation of a machine in the exemplary form of a computer system 500 within which a set of instructions for causing the machine to perform any one or more of the methodologies discussed herein, may be executed. In alternative implementations, the machine may be connected (e.g., networked) to other machines in a LAN, an intranet, or the Internet. The machine may operate in the capacity of a server or a client machine in a client-server network environment, or as a peer machine in a peer-to-peer (or distributed) network environment. The machine may be a personal computer (PC), a tablet PC, a set-top box (STB), a Personal Digital Assistant (PDA), a cellular telephone, a web appliance, a server, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The exemplary computer system 500 includes a processing device (processor) 502, a main memory 504 (e.g., read-only memory (ROM), flash memory, dynamic random access memory (DRAM) such as synchronous DRAM (SDRAM) or Rambus DRAM (RDRAM), etc.), a static memory 506 (e.g., flash memory, static random access memory (SRAM), etc.), and a data storage device 518, which communicate with each other via a bus 508.

Processor 502 represents one or more general-purpose processing devices such as a microprocessor, central processing unit, or the like. More particularly, the processor 502 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The processor 502 may also be one or more special-purpose processing devices such as an application specific integrated circuit (ASIC), a field programmable gate array (FPGA), a digital signal processor (DSP), network processor, or the like. The processor 502 is configured to execute instructions 526 for performing the operations and steps discussed herein.

The computer system 500 may further include a network interface device 522. The computer system 500 also may include a video display unit 510 (e.g., a liquid crystal display (LCD), a cathode ray tube (CRT), or a touch screen), an alphanumeric input device 512 (e.g., a keyboard), a cursor control device 514 (e.g., a mouse), and a signal generation device 520 (e.g., a speaker).

The data storage device 518 may include a computer-readable storage medium 524 on which is stored one or more sets of instructions 526 (e.g., software) embodying any one or more of the methodologies or functions described herein (e.g., processing device 102). The instructions 526 may also reside, completely or at least partially, within the main memory 504 and/or within the processor 502 during execution thereof by the computer system 500, the main memory 504 and the processor 502 also constituting computer-readable storage media. The instructions 526 may further be transmitted or received over a network 574 via the network interface device 522.

While the computer-readable storage medium 524 is shown in an exemplary implementation to be a single medium, the term "computer-readable storage medium" should be taken to include a single medium or multiple media (e.g., a centralized or distributed database, and/or associated caches and servers) that store the one or more sets of instructions. The term "computer-readable storage medium" shall also be taken to include any medium that is capable of storing, encoding or carrying a set of instructions for execution by the machine and that cause the machine to perform any one or more of the methodologies of the present disclosure. The term "computer-readable storage medium" shall accordingly be taken to include, but not be limited to, solid-state memories, optical media, and magnetic media.

In the foregoing description, numerous details are set forth. It will be apparent, however, to one of ordinary skill in the art having the benefit of this disclosure, that the present disclosure may be practiced without these specific details. In some instances, well-known structures and devices are shown in block diagram form, rather than in detail, in order to avoid obscuring the present disclosure.

Some portions of the detailed description have been presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "segmenting", "analyzing", "determining", "enabling", "identifying," "modifying" or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

The disclosure also relates to an apparatus for performing the operations herein. This apparatus may be specially constructed for the required purposes, or it may include a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such.

Reference throughout this specification to "one implementation" or "an implementation" means that a particular feature, structure, or characteristic described in connection with the implementation is included in at least one implementation. Thus, the appearances of the phrase "in one implementation" or "in an implementation" in various places throughout this specification are not necessarily all referring to the same implementation. In addition, the term "or" is intended to mean an inclusive "or" rather than an exclusive "or."

It is to be understood that the above description is intended to be illustrative, and not restrictive. Many other implementations will be apparent to those of skill in the art upon reading and understanding the above description. The scope of the disclosure should, therefore, be determined with reference to the appended claims, along with the full scope of equivalents to which such claims are entitled.

What is claimed is:

1. A method comprising:

receiving, by a processing device, a plurality of sound signals captured at a plurality of microphone sensors, wherein the plurality of sound signals are from a sound source, and wherein a number (M) of the plurality of microphone sensors is greater than three;

determining a number (K) of layers for a multistage minimum variance distortionless response (MVDR) beamformer based on the number (M) of the plurality of microphone sensors, wherein the number (K) of layers is greater than one, and wherein each layer of the multistage MVDR beamformer comprises one or more mini-length MVDR beamformers; and executing the multistage MVDR beamformer to the plurality of sound signals to calculate an estimate of the sound source.

2. The method of claim 1, wherein a length (M') of the one or more mini-length MVDR beamformers is smaller than the number (M) of the plurality of microphone sensors.

3. The method of claim 1, wherein the multistage MVDR beamformer comprises K cascaded layers from a first layer to a $K^{th}$ layer, and wherein a count of mini-length MVDR beamformers in each of the K layers progressively decreases from the first layer to the $K^{th}$ layer.

4. The method of claim 3, wherein the first layer comprises M/2 length-2 MVDR beamformers configured to receive the plurality of sound signals, wherein each of the M/2 length-2 MVDR beamformers is configured to receive respective two sound signals and to calculate a first-layer estimate for the two respective sound signals, and wherein first layer estimates are provided to a second layer of the multistage MVDR beamformer.

5. The method of claim 4, wherein each of second layer to the $K^{th}$ layer comprises one or more length-2 MVDR beamformers, and wherein a count of length-2 MVDR beamformers of from the second layer to the $K^{th}$ layer decreases by a factor of two.

6. The method of claim 5, wherein the $K^{th}$ layer of the multistage MVDR beamformer comprises one length-2 MVDR beamformer configured to calculate the estimate of the sound source.

7. The method of claim 3, wherein the first layer comprises M/3 length-3 MVDR beamformers to receive the plurality of sound signals, wherein each of the M/3 length-3 MVDR beamformers is configured to receive respective three sound signals and to calculate a first-layer estimate for the three respective sound signals, and wherein first layer estimates are provided to a second layer of the multistage MVDR beamformer.

8. The method of claim 1, wherein the multistage MVDR beamformer comprises a first mini-length MVDR beamformer and a second mini-length MVDR beamformer, and wherein a length of the first mini-length MVDR beamformer is different from the second mini-length MVDR.

9. The method of claim 8, wherein the first mini-length MVDR beamformer and the second mini-length MVDR beamformer are in a same layer.

10. The method of claim 8, wherein the first mini-length MVDR beamformer and the second mini-length MVDR beamformer are in different layers.

11. The method of claim 1, further comprising:

determining one of more coefficients for the one or more mini-length MVDR beamformers in the K layers of the multistage MVDR beamformer based on a noise correlation at input of the one or more mini-length MVDR beamformer.

12. The method of claim 1, wherein the plurality of sound signals comprise a first component from a speech source and a second component of noise, and wherein the multistage MVDR beamformer calculate an estimate of the speech source.

13. A non-transitory machine-readable storage medium storing instructions which, when executed, cause a processing device to:

receive, by a processing device, a plurality of sound signals captured at a plurality of microphone sensors, wherein the plurality of sound signals are from a sound source, and wherein a number (M) of the plurality of microphone sensors is greater than three;

determine a number (K) of layers for a multistage minimum variance distortionless response (MVDR) beamformer based on the number (M) of the plurality of microphone sensors, wherein the number (K) of layers is greater than one, and wherein each layer of the multistage MVDR beamformer comprises one or more mini-length MVDR beamformers; and execute the multistage MVDR beamformer to the plurality of sound signals to calculate an estimate of the sound source.

14. The non-transitory machine-readable storage medium of claim 13, wherein the multistage MVDR beamformer comprises K cascaded layers from a first layer to a $K^{th}$ layer, and wherein a count of mini-length MVDR beamformers in each of the K layers progressively decreases from the first layer to the $K^{th}$ layer.

15. The non-transitory machine-readable storage medium of claim 14, the first layer comprises M/2 length-2 MVDR beamformers configured to receive the plurality of sound signals, wherein each of the M/2 length-2 MVDR beamformers is configured to receive respective two sound signals and to calculate a first-layer estimate for the two respective sound signals, and wherein first layer estimates are provided to a second layer of the multistage MVDR beamformer.

16. The non-transitory machine-readable storage medium of claim 15, wherein each of second layer to the $K^{th}$ layer comprises one or more length-2 MVDR beamformers, wherein a count of length-2 MVDR beamformers of from the second layer to the $K^{th}$ layer decreases by a factor of two, and wherein the $K^{th}$ layer of the multistage MVDR beamformer comprises one length-2 MVDR beamformer configured to calculate the estimate of the sound source.

17. A system, comprising:

a memory; and a processing device, operatively coupled to the memory, to:

receive a plurality of sound signals captured at a plurality of microphone sensors, wherein the plurality of sound signals are from a sound source, and wherein a number (M) of the plurality of microphone sensors is greater than three, determine a number (K) of layers for a multistage minimum variance distortionless response (MVDR) beamformer based on the number (M) of the plurality of microphone sensors, wherein the number (K) of layers is greater than one, and wherein each layer of the multistage MVDR beamformer comprises one or more mini-length MVDR beamformers, and execute the multistage MVDR beamformer to the plurality of sound signals to calculate an estimate of the sound source.

18. The system of claim 17, wherein the multistage MVDR beamformer comprises K cascaded layers from a first layer to a $K^{th}$ layer, and wherein a count of mini-length MVDR beamformers in each of the K layers progressively decreases from the first layer to the $K^{th}$ layer.

19. The system of claim 18, the first layer comprises M/2 length-2 MVDR beamformers configured to receive the plurality of sound signals, wherein each of the M/2 length-2 MVDR beamformers is configured to receive respective two sound signals and to calculate a first-layer estimate for the two respective sound signals, and wherein first layer estimates are provided to a second layer of the multistage MVDR beamformer.

20. The system of claim 19, wherein each of second layer to the $K^{th}$ layer comprises one or more length-2 MVDR beamformers, wherein a count of length-2 MVDR beamformers of from the second layer to the $K^{th}$ layer decreases by a factor of two, and wherein the $K^{th}$ layer of the multistage MVDR beamformer comprises one length-2 MVDR beamformer configured to calculate the estimate of the sound source.

* * * * *